US012510284B2

(12) United States Patent
Winckler et al.

(10) Patent No.: US 12,510,284 B2
(45) Date of Patent: Dec. 30, 2025

(54) ANTI-MICROBIAL STAND-ALONE ICE MAKING APPLIANCE

(71) Applicant: Haier US Appliance Solutions, Inc., Wilmington, DE (US)

(72) Inventors: Rachel Winckler, Louisville, KY (US); Samuel Vincent DuPlessis, Louisville, KY (US); Eric Muzzillo, Louisville, KY (US); Lauren Platts, Louisville, KY (US); Annie Han, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 96 days.

(21) Appl. No.: 18/448,832

(22) Filed: Aug. 11, 2023

(65) Prior Publication Data

US 2025/0052473 A1 Feb. 13, 2025

(51) Int. Cl.
*F25C 5/182* (2018.01)
*F25C 1/00* (2006.01)

(52) U.S. Cl.
CPC ..... *F25C 5/182* (2013.01); *F25C 1/00* (2013.01); *F25C 2400/12* (2013.01); *F25C 2400/14* (2013.01)

(58) Field of Classification Search
CPC ..... F25C 5/182; F25C 1/00; F25C 2400/12; F25C 2400/14
See application file for complete search history.

(56) References Cited

U.S. PATENT DOCUMENTS

| | | | | |
|---|---|---|---|---|
| 7,032,406 | B2 | 4/2006 | Hollen et al. | |
| 7,340,913 | B2 | 3/2008 | Miller et al. | |
| 8,197,728 | B2 | 6/2012 | Lee et al. | |
| 2012/0198870 | A1* | 8/2012 | Erbs | F25C 1/12 62/347 |
| 2014/0162036 | A1* | 6/2014 | Marcellus | B32B 17/10018 156/60 |
| 2016/0203698 | A1* | 7/2016 | Steinbok | A47G 29/00 340/521 |
| 2017/0231403 | A1* | 8/2017 | Eget | A47F 3/0447 454/192 |
| 2019/0316824 | A1* | 10/2019 | Tarr | F25D 17/02 |

FOREIGN PATENT DOCUMENTS

| | | | |
|---|---|---|---|
| CN | 107003059 B | | 11/2019 |
| CN | 210727544 U | * | 6/2020 |

OTHER PUBLICATIONS

CN-210727544-U translation.*

* cited by examiner

*Primary Examiner* — Elizabeth J Martin
(74) *Attorney, Agent, or Firm* — Dority & Manning, P.A.

(57) ABSTRACT

An ice making appliance includes a casing, a user interface on the casing, a container within the casing, and a reservoir disposed within the casing. The ice making appliance includes one or more injection molded parts with anti-microbial ingredients. The ice making appliance may include an auxiliary reservoir disposed outside of the casing.

20 Claims, 5 Drawing Sheets

ANTI-MICROBIAL STAND-ALONE ICE MAKING APPLIANCE

FIELD OF THE INVENTION

The present subject matter relates generally to ice making appliances, and more particularly to components of ice making appliances that produce nugget ice.

BACKGROUND OF THE INVENTION

Stand-alone ice making appliances are separate appliances from refrigerator appliances and provide independent ice supplies. Generally, liquid water is added to the stand-alone ice makers, and the ice maker operates to freeze the liquid water and form ice. Ice making appliances have many components that are regular points of contact for users. Users frequently add tap water to the stand-alone ice making appliance and frequently touch and hold various components of the ice making appliance. Typical contact points can pass germs or accumulate bacterial growth over time. Various contact points can transfer germs to the ice produced by the ice making appliance. Additionally, water contact points can hold water and start to grow mold or other bacteria.

Accordingly, improved stand-alone ice making appliances are desired in the art. In particular, stand-alone ice making appliances that address the transfer of germs and growing of mold within the appliance would be advantageous.

BRIEF DESCRIPTION OF THE INVENTION

Aspects and advantages of the invention will be set forth in part in the following description, or may be obvious from the description, or may be learned through practice of the invention.

In one example embodiment, a stand-alone ice making appliance includes a casing, a user interface on the casing, a container within the casing, a handle extending from the container, a reservoir disposed within the casing, an ice maker disposed within the casing, and a pump disposed within the casing. The pump is in fluid communication with the reservoir and the ice maker. The pump is operable to flow water from the reservoir to the ice maker. The stand-alone ice making appliance also includes an auxiliary reservoir disposed outside of the casing. One or more of the casing, the user interface, the handle, and the reservoir includes built-in anti-microbial ingredients.

In another example embodiment, an ice making appliance includes a casing, a user interface on the casing, a container within the casing, and a reservoir disposed within the casing. The ice making appliance includes one or more injection molded parts with anti-microbial ingredients.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
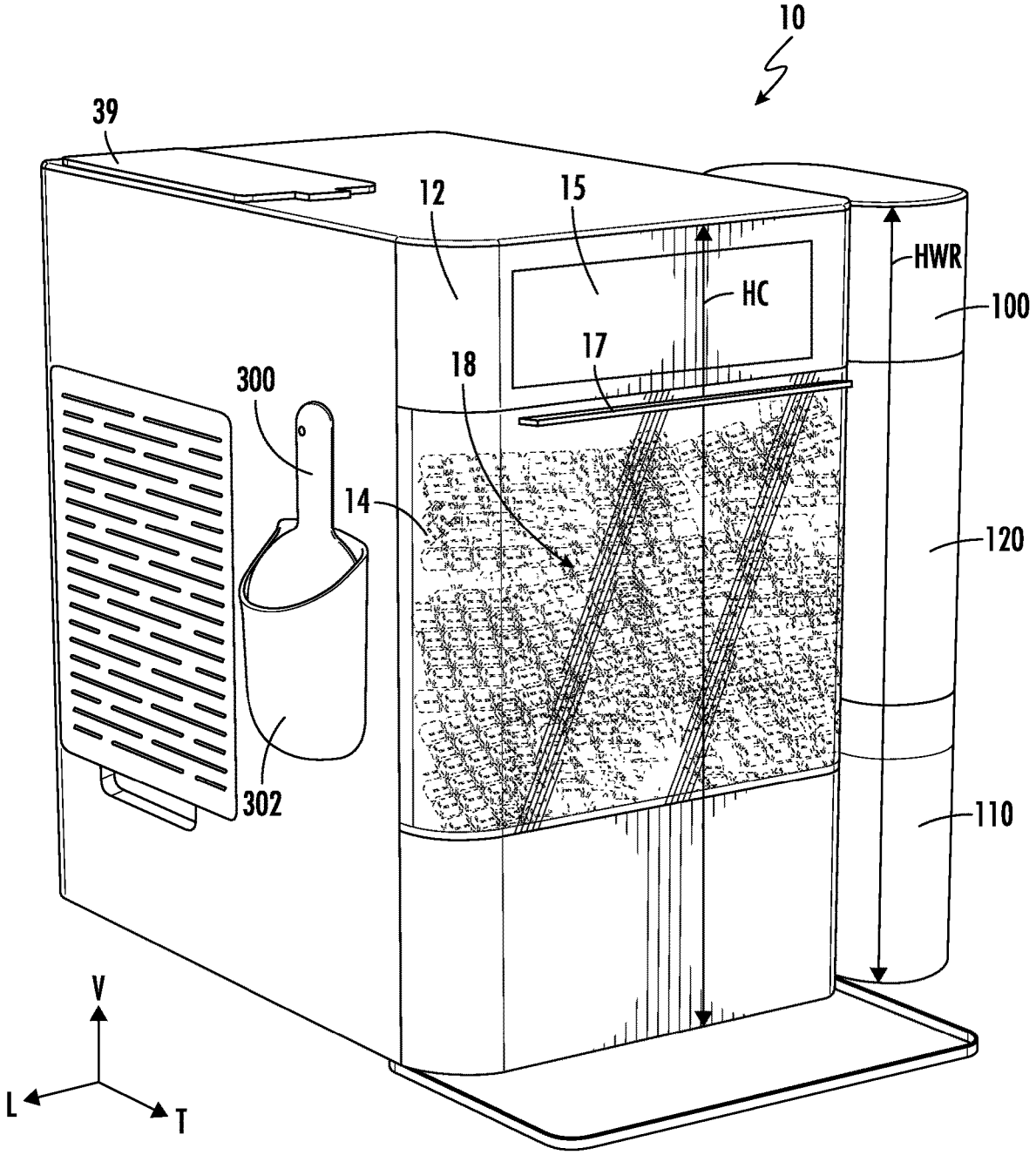
FIG. 1 is a perspective view of an appliance according to an example embodiment of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
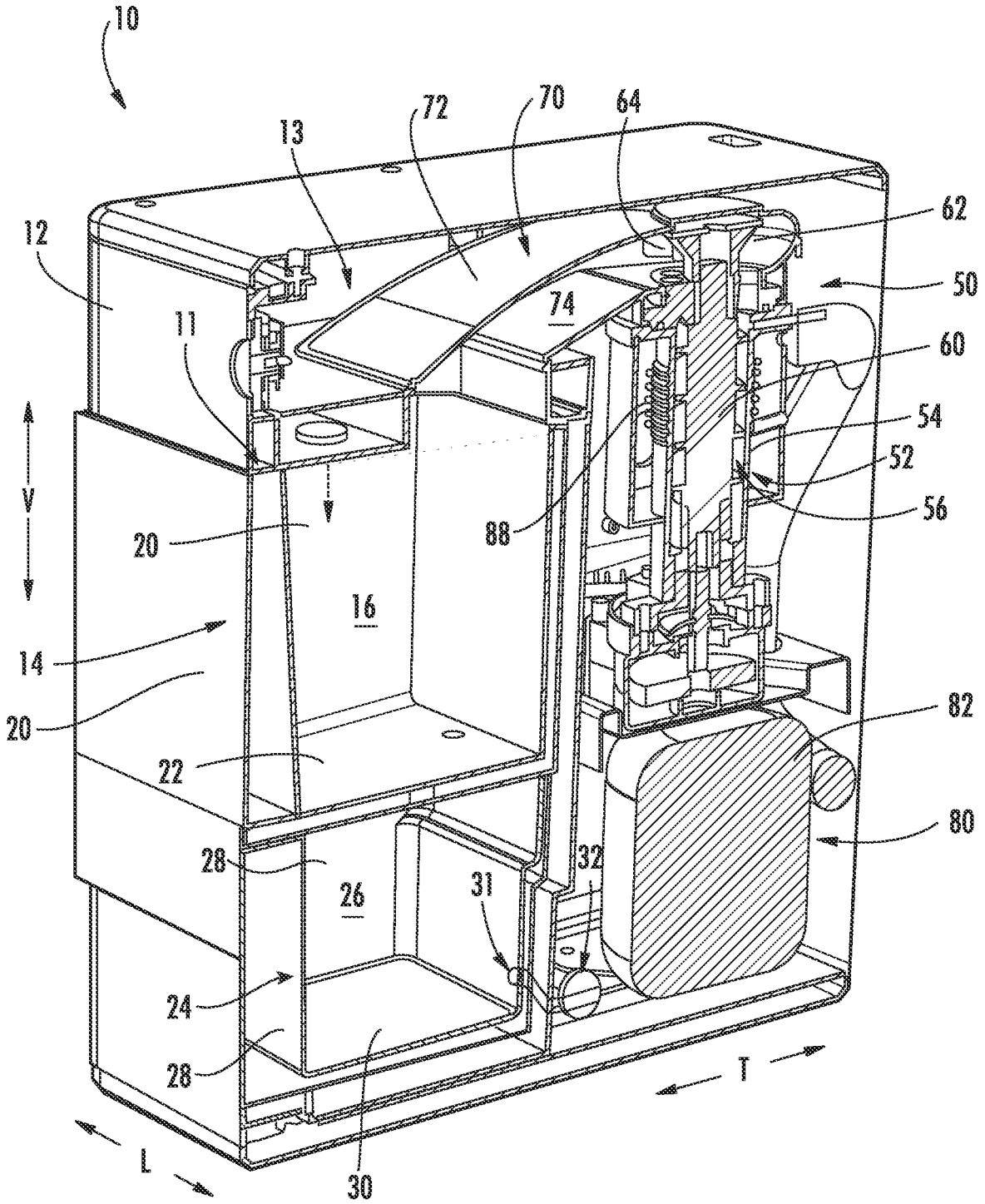
FIG. 2 is a perspective section view of the example appliance of FIG. 1.
Figure 3:
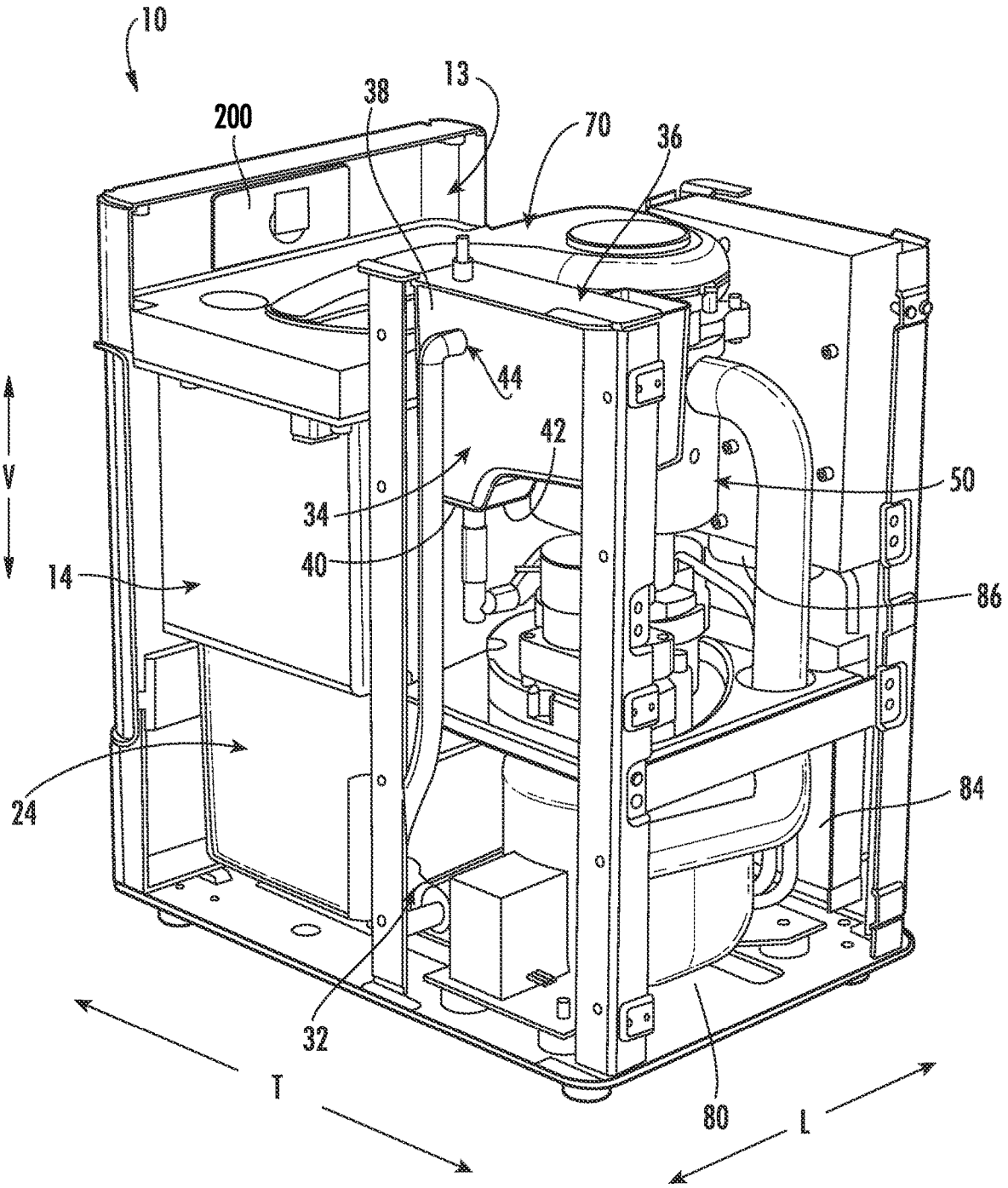
FIG. 3 is a rear perspective view of the example appliance of FIG. 1 with a casing of the example appliance removed to show interior components of the example appliance.

Referring now to FIGS. 1 through 3, one embodiment of an appliance 10 in accordance with the present disclosure is illustrated. As shown, appliance 10 is provided as a stand-alone ice making appliance embodiment. Appliance 10 includes an outer casing 12 which defines a primary opening 11 (e.g., first primary opening) and an internal cavity or volume 13. Internal volume 13 generally at least partially houses various other components of the appliance therein 10. Primary opening 11 defined in outer casing 12 may extend internal volume 13 to an ambient environment. Through primary opening 11, access (e.g., by a user) to the internal volume 13 may be permitted. Outer casing 12 further defines a vertical direction V, a lateral direction L, and a transverse direction T. The vertical direction V, lateral direction L, and transverse direction T are mutually perpendicular and form an orthogonal direction system.

A container 14 of appliance 10 is also illustrated. Container 14 defines a first storage volume 16 for the receipt and storage of ice 18 therein. A user of the appliance 10 may access ice 18 within the container 14 for consumption or other uses, as described in detail below. Container 14 may include multiple walls, including one or more sidewalls 20 and a base wall 22, which may together define the first storage volume 16. In example embodiments, at least one sidewall 20 may be formed in part from a clear, see-through (i.e., transparent or translucent) material, such as a clear glass or plastic, such that a user can see into the first storage volume 16 and thus view ice 18 therein. For instance, at least one sidewall 20 may include a separate external panel and internal panel formed from a clear, see-through (i.e., transparent or translucent) material, such as a clear glass or plastic. In some example embodiments. container 14 may include a handle 17. In general, handle 17 may advantageously improve accessibility to ice 18 within container 14. Further, in example embodiments, container 14 may be removable, such as from the outer casing 12, by a user. This facilitates advantageous easy access by the user to ice within the container 14, as discussed below. In general, a user interface 15 may be positioned on casing 12 above container 14. The user interface 15 may generally include input selectors to be selected (e.g., by a user) for controlling the appliance 10.

Appliances 10 in accordance with the present disclosure are advantageously stand-alone appliances, and thus are not connected to refrigerators or other appliances. Additionally, in example embodiments, such appliances are not connected to plumbing or another water source that is external to the appliance 10, such as a refrigerator water source. Rather, in example embodiments, water is initially supplied to the appliance 10 manually by a user, such as by pouring water into water tank 24 and/or an auxiliary reservoir 100. Optionally, in example embodiments, water tank 24 may be removable, such as from the outer casing 12, by a user. This facilitates advantageous easy access by the user to water tank 24 (e.g., in order to easily fill water tank 24), as discussed below.

Notably, appliances 10 as discussed herein include various features which allow the appliances 10 to be affordable and desirable to typical consumers. For example, the stand-alone feature reduces the cost associated with the appliance 10 and allows the consumer to position the appliance 10 at any suitable desired location, with the only requirement in some embodiments being access to an electrical source. In example embodiments, such as those shown in FIGS. 1 through 3, the removable container 14 allows easy access to ice 18 within first storage volume 16 and allows the container 14 to be moved to a different position from the remainder of the appliance 10 for ice usage purposes. Additionally, in some example embodiments, appliance 10 may include a scoop 300 and a scoop holder 302 positioned on casing 12 of appliance 10. Scoop 300 may be selectively removable from scoop holder 302, such that scoop 300 may be inserted within container 14 to ease the acquisition (e.g., by a user) of ice 18 from within container 14.

As discussed herein, appliance 10 is configured to make nugget ice, which is becoming increasingly popular with consumers. Ice 18 may be nugget ice. Generally, nugget ice is ice that that is maintained or stored (i.e., in first storage volume 16 of container 14) at a temperature greater than the melting point of water or greater than about thirty-two degrees Fahrenheit. Accordingly, the ambient temperature of the environment surrounding the container 14 may be at a temperature greater than the melting point of water or greater than about thirty-two degrees Fahrenheit. In some embodiments, such temperature may be greater than forty degrees Fahrenheit, greater than fifty degrees Fahrenheit, or greater than sixty degrees Fahrenheit.

Still referring to FIGS. 1 through 3, various components of appliance 10 in accordance with the present disclosure are illustrated. For example, as mentioned, appliance 10 includes a water tank 24. The water tank 24 defines a second storage volume 26 for the receipt and holding of water. Water tank 24 may include multiple walls, including one or more sidewalls 28 and a base wall 30, which may together define the second storage volume 26. In example embodiments, the water tank 24 may be disposed below the container 14 along the vertical direction V defined for the appliance 10, as shown.

As discussed, in example embodiments, water is provided to the water tank 24 for use in forming ice. Accordingly, appliance 10 may further include a pump 32. Pump 32 may be in fluid communication with the second storage volume 26. For example, water may be flowable from the second storage volume 26 through a fluid outlet 31 defined in the water tank 24, such as in a sidewall 28 thereof, and may flow through a conduit to and through pump 32. Pump 32 may, when activated, be operable to actively flow water from the second storage volume 26 therethrough and from the pump 32.

Figure 5:
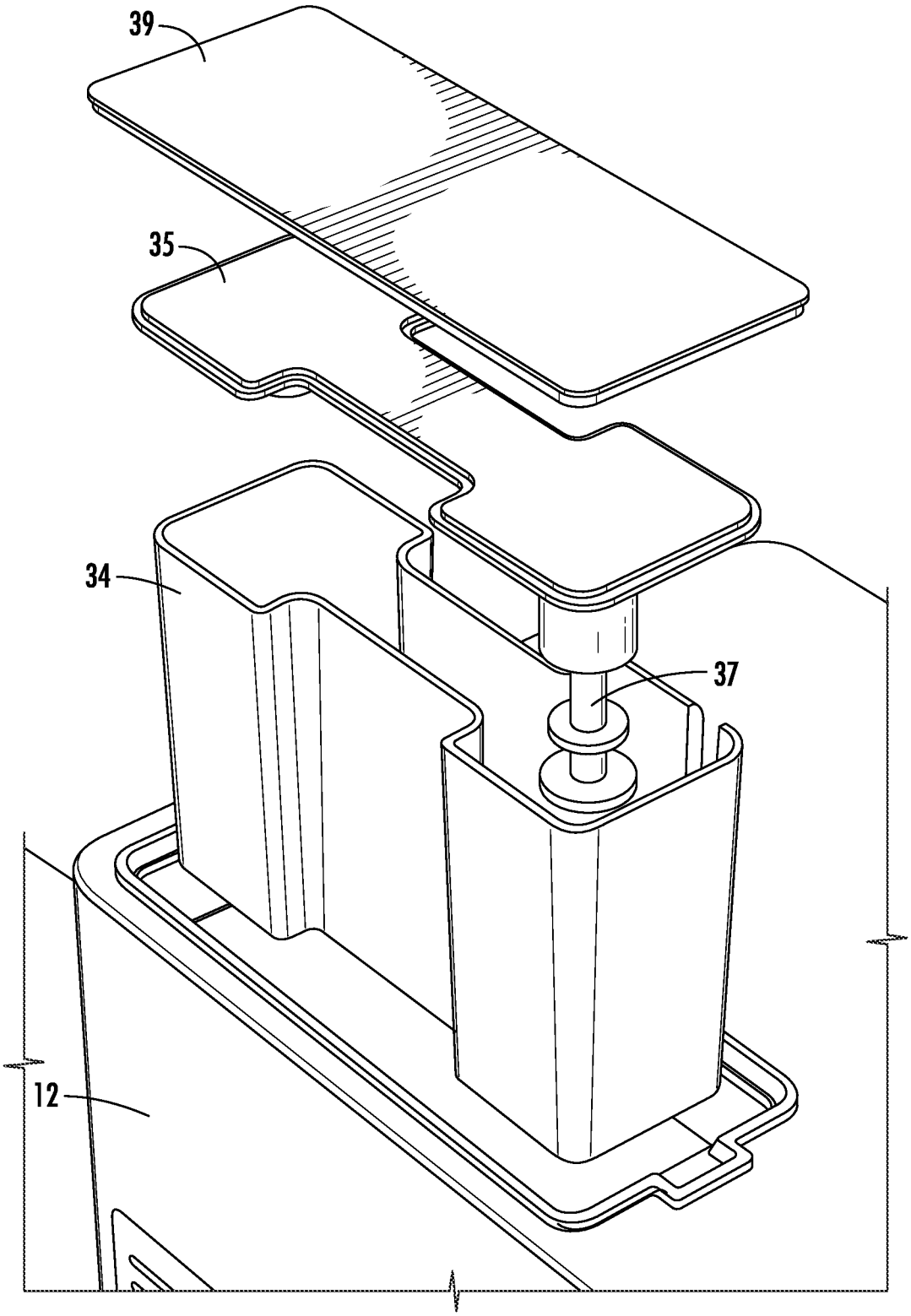
FIG. 5 is an exploded perspective view of a portion of the example appliance of FIG. 1.

Water actively flowed from the pump 32 may be flowed (e.g., through a suitable conduit) to a reservoir 34. For example, reservoir 34 may define a third storage volume 36. In some embodiments, third storage volume 36 is defined by one or more sidewalls 38 and a base wall 40. Third storage volume 36 may, for example, be in fluid communication with the pump 32 and may thus receive water that is actively flowed from the water tank 24, such as through the pump 32. During operation, water may be flowed into the third storage volume 36 through an opening 44 defined in the reservoir 34. Referring briefly to FIG. 5, provided is an exploded perspective view of reservoir 34. Reservoir 34 may generally include a cover 39 encasing reservoir 34 within casing 12. In some example embodiments, reservoir may include an internal lid 35 to seal the reservoir 34 within casing 12. Internal lid 35 may include a float sensor 37 for monitoring the water level inside of reservoir 34.

Referring again to FIGS. 1 through 3, reservoir 34 and third storage volume 36 thereof may receive and contain water to be provided to an ice maker 50 for the production of ice. Accordingly, third storage volume 36 may be in fluid communication with ice maker 50. For example, water may be flowed, such as through an opening 42 and through suitable conduits, from third storage volume 36 to ice maker 50.

Ice maker 50 generally receives water, such as from reservoir 34, and freezes the water to form ice 18. In example embodiments, ice maker 50 is a nugget ice maker, and in particular is an auger-style ice maker, although other suitable styles of ice makers and/or appliances are within the scope and spirit of the present disclosure. As shown, ice maker 50 may include a casing 52 into which water from third storage volume 36 is flowed. Casing 52 is thus in fluid communication with third storage volume 36. For example, casing 52 may include one or more sidewalls 54 which may define an interior volume 56, and an opening may be defined in a sidewall 54. Water may be flowed from third storage volume 36 through the opening (such as via a suitable conduit) into the interior volume 56.

As illustrated, an auger 60 may be disposed at least partially within the casing 52. During operation, the auger 60 may rotate. Water within the casing 52 may at least partially freeze due to heat exchange, such as with a refrigeration system as discussed herein. The at least partially frozen water may be lifted by the auger 60 from casing 52. Further, in example embodiments, the at least partially frozen water may be directed by auger 60 to and through an extruder 62. The extruder 62 may extrude the at least partially frozen water to form ice, such as nuggets of ice 18.

Formed ice 18 may be provided by the ice maker 50 to container 14, and may be received in the first storage volume 16 thereof. For example, ice 18 formed by auger 60 and/or extruder 62 may be provided to the container 14. In example embodiments, appliance 10 may include a chute 70 for directing ice 18 produced by the ice maker 50 towards the first storage volume 16. For example, as shown, chute 70 is generally positioned above container 14 along the vertical direction V. Thus, ice can slide off of chute 70 and drop into storage volume 16 of container 14. Chute 70 may, as shown, extend between ice maker 50 and container 14, and may include a body 72, which defines a passage 74 therethrough. Ice 18 may be directed from the ice maker 50 (such as from the auger 60 and/or extruder 62) through the passage 74 to the container 14. In some embodiments, for example, a sweep 64, which may be connected to and rotate with the auger, may contact the ice emerging through the extruder 62 from the auger 60 and direct the ice 18 through the passage 74 to the container 14.

As discussed, water within the casing 52 may at least partially freeze due to heat exchange, such as with a refrigeration system. In example embodiments, ice maker 50 may include a sealed refrigeration system 80. The sealed refrigeration system 80 may be in thermal communication with the casing 52 to remove heat from the casing 52 and interior volume 56 thereof, thus facilitating freezing of water therein to form ice. Sealed refrigeration system 80 may, for example, include a compressor 82, a condenser 84, a throttling device 86, and an evaporator 88. Evaporator 88 may, for example, be in thermal communication with the casing 52 in order to remove heat from the interior volume 56 and water therein during operation of sealed system 80. For example, evaporator 88 may at least partially surround the casing 52. In particular, evaporator 88 may be a conduit coiled around and in contact with casing 52, such as the sidewall(s) 54 thereof.

It should additionally be noted that, in example embodiments, a controller 200 may be in operative communication with the sealed system 80, such as with the compressor 82 thereof, and may activate the sealed system 80 as desired or required for ice making purposes.

In example embodiments, controller 200 is in operative communication with the pump 32. Such operative communication may be via a wired or wireless connection, and may facilitate the transmittal and/or receipt of signals by the controller 200 and pump 32. Controller 200 may be configured to activate the pump 32 to actively flow water. For example, controller 200 may activate the pump 32 to actively flow water therethrough when, for example, reservoir 34 requires water. A suitable sensor(s), for example, may be provided in the third storage volume 36. The sensor(s) may be in operative communication with the controller 200 and may be configured to transmit signals to the controller 200, which indicate whether or not additional water is desired in the reservoir 34. When controller 200 receives a signal that water is desired, controller 200 may send a signal to pump 32 to activate pump 32.

Figure 4:
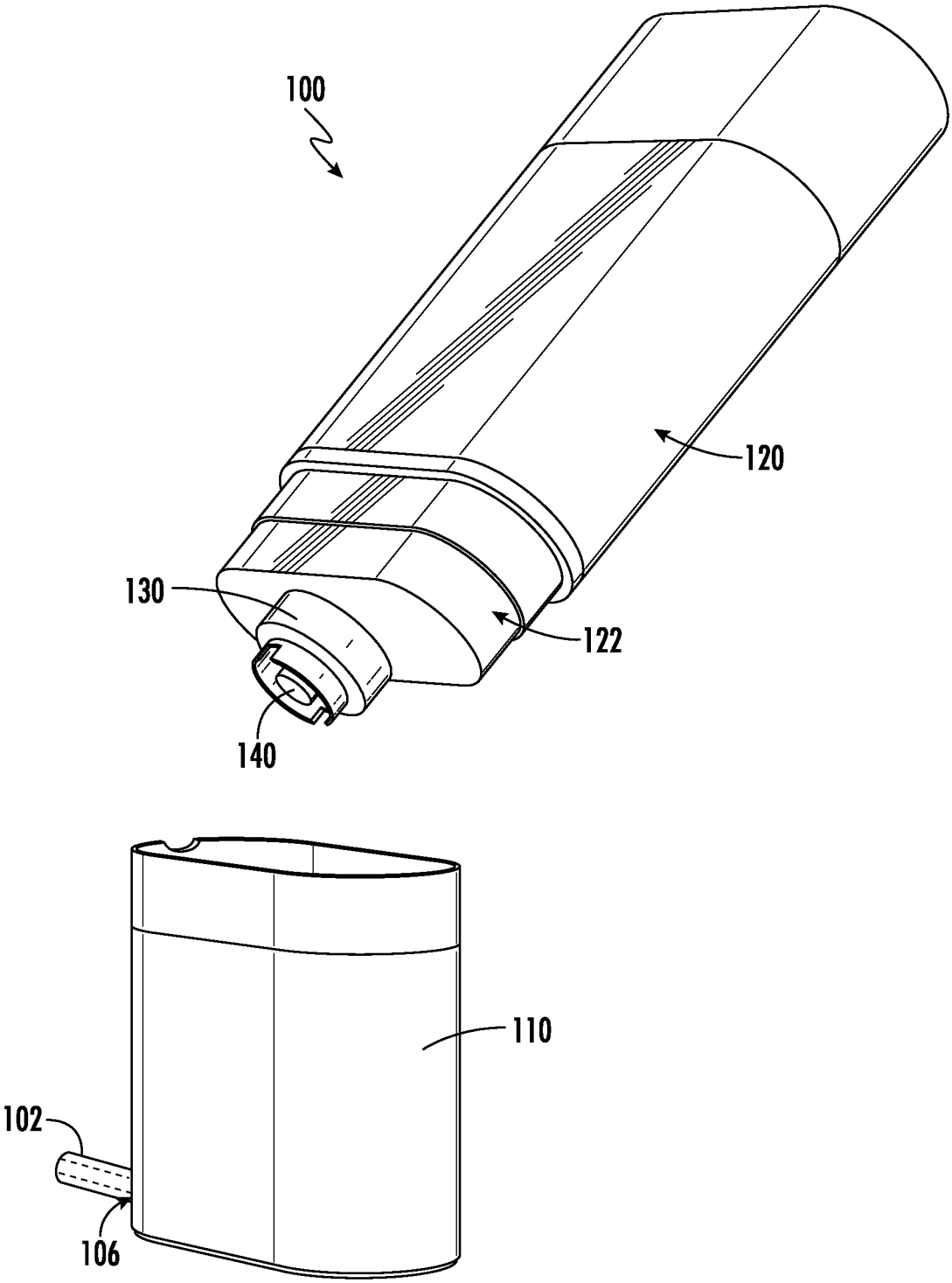
FIG. 4 is a perspective view of the example auxiliary reservoir in FIG. 1.

As shown in FIG. 1, appliance 10 may also include an auxiliary water reservoir 100. FIG. 4 also illustrates auxiliary water reservoir 100 according to another example embodiment. Auxiliary water reservoir 100 is described in greater detail below with reference to FIGS. 1 and 4. As may be seen in FIG. 1, a height HWR of auxiliary water reservoir 100 may be about equal to a height HC of casing 12. Thus, the appearance of auxiliary water reservoir 100 may complement casing 12.

Auxiliary water reservoir 100 may be disposed outside of casing 12. For example, auxiliary water reservoir 100 may be mounted at the side of casing 12. Thus, while most components of appliance 10 are housed within casing 12, auxiliary water reservoir 100 is positioned outside of casing 12. In certain example embodiments, auxiliary water reservoir 100 may include a base 110 and a container 120. Base 110 may be attached to casing 12, e.g., at the side of casing 12 adjacent to the bottom of casing 12. For instance, base 110 may be clipped, fastened, etc. to casing 12. As may be seen in FIG. 4, container 120 is removably mounted to base 110. For example, a cap 130 positioned at a bottom portion 122 of container 120 may be received within base 110 to mount container 120 on base 110. A user may lift upwardly on container 120 to remove container 120 from base 110, and the user may insert cap 130 of container 120 into base 110 to mount container 120 on base 110. As an example, the user may remove container 120 from base 110 in order to conveniently fill container 120 with water at a faucet.

Auxiliary water reservoir 100 may be in fluid communication with a water tank within casing 12 such that water within auxiliary water reservoir 100 is flowable to the water tank. For example, a flexible tubing conduit, or a supply line 102, may extend from auxiliary water reservoir 100 to water tank 24, and water from within auxiliary water reservoir 100 may flow from auxiliary water reservoir 100 into second storage volume 26 via supply line 102. It will be understood that appliance 10 may be plumbed in any other suitable manner to deliver water from auxiliary water reservoir 100 into casing 12 for use with ice maker 50 in alternative example embodiments.

Auxiliary water reservoir 100 may include a check valve 140, such as a normally closed check valve. Check valve 140 may be mounted to container 120, e.g., positioned in cap 130 at bottom portion 122 of container 120. Check valve 140 may be configured such that check valve 140 is open when container 120 is mounted to base 110. In addition, check valve 140 may be configured such that check valve 140 is closed when container 120 is removed from base 110. When check valve 140 is open, check valve 140 may allow water within container 120 to flow into base 110. Within base 110, the water may flow to outlet 106 and thus supply line 102, as described above.

It should be appreciated that various components of appliance 10 may be formed from any suitably rigid material. For example, according to example embodiments, components such as casing 12, user interface 15, handle 17, reservoir 34, internal lid 35, float sensor 37, cover 39, supply line 102, cap 130, scoop 300 and scoop holder 302 may be formed by injection molding, e.g., using a suitable plastic material, such as injection molding grade Polybutylene Terephthalate (PBT), Nylon 6, high impact polystyrene (HIPS), acrylonitrile butadiene styrene (ABS), or any other suitable blend of polymers.

In general, ice making appliances have many components that are regular points of contact for users. For example, users may frequently add tap water to the auxiliary reservoir 100 of stand-alone ice making appliance 10, frequently touching and holding various components of the ice making appliance 10. As such, various components of appliance 10, such as casing 12, user interface 15, handle 17, reservoir 34, internal lid 35, float sensor 37, cover 39, supply line 102, cap 130, scoop 300 and scoop holder 302 may include built-in anti-microbial ingredients. For example, each of the components listed above may include an injection molded plastic material with built-in anti-microbial ingredients.

Particularly, the built-in anti-microbial ingredients may be provided by adding one or more of any suitable anti-microbial ingredients, such as silver phosphate glass active ingredients, during the injection molding process, e.g., adding silver phosphate glass active ingredients to the suitable plastic material before the components are formed by injection molding, e.g., adding silver phosphate glass active ingredients to the plastic material before injecting into the mold. For example, suitable anti-microbial ingredients may be any ingredient or combination of ingredients to reduce bacterial growth, e.g., suitable antimicrobial materials may be sold under the MICROBAN® brand or label, such as MICROBAN® SILVERSHIELD® additives may be added to the injection molding process to provide the built-in anti-microbial ingredients. For example, any one or more of the casing 12, user interface 15, handle 17, reservoir 34, internal lid 35, float sensor 37, cover 39, supply line 102, cap 130, scoop 300 and scoop holder 302 may include an injection molded plastic material with anti-microbial additives, e.g., any two (2) or more of the foregoing parts, or any suitable combination up to and including all of the foregoing parts and/or additional parts of the ice making appliance as well as or instead of the one or more of the foregoing example parts, may include an injection molded plastic material with anti-microbial ingredients. One of skill in the art would understand supply line 102 is provided as an example, and any suitable flexible tubing conduit within appliance 10 may be provided with silver phosphate glass active ingredients via injection molding. Additionally or alternatively, in some embodiments, only reservoir 34 may include built-in anti-microbial ingredients.

Moreover, one of skill in the art would understand the appliance 10 described herein is by way of example only. Particularly, the present disclosure may be used with any suitable ice making appliance, i.e., ice making appliance 10 may be any stand-alone ice making appliance, such as any countertop ice making appliance having one or more injection molded parts with anti-microbial ingredients. For example, the nugget ice making system, e.g., including the auger and the cylinder, is provided by way of example only and aspects of the present disclosure may also be used with other ice makers such as clear ice makers or ice makers including a mold body, e.g., which form ice cubes, among other possible variations in the ice making appliance according to the present disclosure.

As may be seen from the above, the present disclosure may advantageously include the addition of one or more anti-microbial additives while producing parts of the stand-alone, countertop, nugget ice maker using injection molding. The built-in anti-microbial properties may disrupt the metabolism of microorganisms by preventing microorganisms from converting nutrients into energy, which inhibits survival, reproduction, and colonization, thus reducing the growth of bacteria, mold, and mildew and helping maintain sanitary surfaces of the product. Additionally, reducing the growth of microorganisms may thereby reduce odors caused by such microorganisms. Ice makers have several touch-points such as the user interface, handle, side tank cap, and ice scoop with scoop holder. Regular interaction with such parts by the consumer may increase the growth and spreading of microorganisms. Thus, the use of anti-microbial additives while making parts using injection molding may reduce the growth of bacteria, mold, and mildew on the surfaces of the ice making appliance, and may reduce odors caused by the bacteria, mold, or mildew.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A stand-alone ice making appliance, comprising:
a casing;
a user interface on the casing;
a container within the casing;
a handle extending from the container;
a reservoir disposed within the casing;
an ice maker disposed within the casing;
a pump disposed within the casing, the pump in fluid communication with the reservoir and the ice maker, the pump operable to flow water from the reservoir to the ice maker; and
an auxiliary reservoir disposed outside of the casing,
wherein one or more of the casing, the user interface, the handle, and the reservoir are injection molded parts comprising built-in anti-microbial ingredients added during injection molding, whereby the built-in anti-microbial ingredients are spread throughout the injection molded parts.

2. The stand-alone ice making appliance of claim 1, wherein the built-in anti-microbial ingredients comprise silver phosphate glass active ingredients.

3. The stand-alone ice making appliance of claim 1, wherein the auxiliary reservoir is in fluid communication with the reservoir within the casing such that water within the auxiliary reservoir is flowable to the reservoir within the casing.

4. The stand-alone ice making appliance of claim 3, wherein the auxiliary reservoir comprises a base and a container, the base attached to the casing, the container removably mounted to the base.

5. The stand-alone ice making appliance of claim 4, wherein the auxiliary reservoir comprises a check valve within a cap mounted to the container, the check valve configured such that the check valve is open when the container is mounted to the base and that the check valve is closed when the container is removed from the base.

6. The stand-alone ice making appliance of claim 5, wherein the cap of the auxiliary reservoir comprises an injection molded plastic material with anti-microbial ingredients added during injection molding.

7. The stand-alone ice making appliance of claim 1, further comprising a scoop holder and a scoop, the scoop holder mounted to the casing of the appliance, the scoop selectively removable from the scoop holder.

8. The stand-alone ice making appliance of claim 7, wherein one or both of the scoop and the scoop holder of the stand-alone ice making appliance comprises an injection molded plastic material with anti-microbial ingredients added during injection molding.

9. The stand-alone ice making appliance of claim 1, further comprising a flexible tubing conduit, the flexible tubing conduit extending from the reservoir to the ice maker.

10. The stand-alone ice making appliance of claim 9, wherein the flexible tubing conduit of the stand-alone ice making appliance comprises an injection molded plastic material with anti-microbial ingredients added during injection molding.

11. An ice making appliance, comprising:

a casing;

a user interface on the casing;

a container within the casing; and a reservoir disposed within the casing, wherein the ice making appliance comprises one or more injection molded parts with anti-microbial ingredients added during injection molding, whereby the anti-microbial ingredients are spread throughout the injection molded parts.

12. The ice making appliance of claim 11, wherein the anti-microbial ingredients comprise silver phosphate glass active ingredients.

13. The ice making appliance of claim 11, further comprising an auxiliary reservoir disposed outside of the casing, the auxiliary reservoir is in fluid communication with the reservoir within the casing such that water within the auxiliary reservoir is flowable to the reservoir within the casing.

14. The ice making appliance of claim 13, wherein the auxiliary reservoir comprises a base and a container, the base attached to the casing, the container removably mounted to the base.

15. The ice making appliance of claim 14, wherein the auxiliary reservoir comprises a check valve within a cap mounted to the container, the check valve configured such that the check valve is open when the container is mounted to the base and that the check valve is closed when the container is removed from the base.

16. The ice making appliance of claim 15, wherein the cap of the auxiliary reservoir comprises an injection molded plastic material with anti-microbial ingredients added during injection molding.

17. The ice making appliance of claim 11, further comprising a scoop holder and a scoop, the scoop holder mounted to the casing of the appliance, the scoop selectively removable from the scoop holder.

18. The ice making appliance of claim 17, wherein the one or both of the scoop and the scoop holder of the stand-alone ice making appliance comprises an injection molded plastic material with anti-microbial ingredients added during injection molding.

19. The ice making appliance of claim 11, further comprising a flexible tubing conduit, the flexible tubing conduit extending from the reservoir to the ice maker.

20. The ice making appliance of claim 19, wherein the flexible tubing conduit of the stand-alone ice making appliance comprises an injection molded plastic material with anti-microbial ingredients added during injection molding.

* * * * *